US006370718B1

(12) United States Patent
Schmid

(10) Patent No.: US 6,370,718 B1
(45) **Date of Patent: *Apr. 16, 2002**

(54) MATTRESS AND METHOD FOR PREVENTING ACCUMULATION OF CARBON DIOXIDE IN BEDDING

(75) Inventor: William R. Schmid, Plymouth, MN (US)

(73) Assignee: Halo Innovations, Inc., Plymouth, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/503,422

(22) Filed: Feb. 14, 2000

Related U.S. Application Data

(63) Continuation of application No. 08/782,249, filed on Jan. 14, 1997, now Pat. No. 6,052,853, which is a continuation-in-part of application No. 08/481,767, filed on Jun. 7, 1995, now abandoned.

(51) Int. Cl.[7] ..... A47C 21/04; A47C 21/08; A47D 7/00; A47G 9/04

(52) U.S. Cl. ..... 5/726; 5/423; 5/425; 5/93.1; 5/732; 5/496; 5/498

(58) Field of Search ..... 5/93.1, 423, 424, 5/425, 427, 428, 724, 726, 732, 739, 100, 494, 496, 498, 655

(56) References Cited

U.S. PATENT DOCUMENTS

| | | | |
|---|---|---|---|
| 206,890 | A | 8/1878 | Squires |
| 494,560 | A | 8/1893 | Floyd |
| 1,142,876 | A | 6/1915 | Davis et al. |
| 2,025,659 | A | 12/1935 | Gilquin |
| 2,059,226 | A | 11/1936 | Gates |
| 2,085,296 | A | 6/1937 | Carey |
| 2,400,790 | A | 5/1946 | Tolen |
| 2,493,067 | A | 1/1950 | Goldsmith |
| 2,512,559 | A | 6/1950 | Williams |
| 2,789,292 | A | 4/1957 | Budinquest |
| 2,815,516 | A | 12/1957 | Holton |
| 2,995,762 | A | 8/1961 | Albinson |
| 3,089,153 | A | 5/1963 | Bosc |
| 3,135,974 | A | 6/1964 | Roman |
| 3,266,064 | A | 8/1966 | Figman |
| 3,486,177 | A | 12/1969 | Marschak |
| 3,529,310 | A | 9/1970 | Olmo |
| 3,644,950 | A | 2/1972 | Lindsay, Jr. |
| 3,681,797 | A | 8/1972 | Messner |
| 4,134,167 | A | 1/1979 | Kazuo |
| 4,206,524 | A | 6/1980 | Cook |
| 4,309,999 | A | 1/1982 | Lueder |
| 4,370,765 | A | 2/1983 | Webber |
| 4,391,009 | A | 7/1983 | Schild et al. |
| 4,536,906 | A | 8/1985 | Varndell et al. |
| 4,620,337 | A | 11/1986 | Williams et al. |
| 4,686,724 | A | 8/1987 | Bedford |
| 4,694,521 | A | 9/1987 | Tominaga |

(List continued on next page.)

FOREIGN PATENT DOCUMENTS

| | | |
|---|---|---|
| DE | 876759 | 5/1953 |
| GB | 14908 | 7/1898 |

*Primary Examiner*—Robert G. Santos
(74) *Attorney, Agent, or Firm*—Merchant & Gould PC

(57) ABSTRACT

A mattress assembly, comprising: substantially nonporous bottom and side walls forming a mattress foundation; a mattress inner core disposed in the mattress foundation being permeable to air; nonporous top cover covering the mattress inner core, the nonporous top cover having apertures at predetermined locations to allow the flow of air therethrough; and a fan disposed with the mattress assembly for forcing air into the mattress inner core whereby the air is forced out the top cover so as to reduce the accumulation of carbon dioxide in bedding on the top cover of the mattress.

11 Claims, 9 Drawing Sheets

U.S. PATENT DOCUMENTS

| | | | | | |
|---|---|---|---|---|---|
| 4,768,251 | A | | 9/1988 | Baskent | |
| 4,825,488 | A | | 5/1989 | Bedford | |
| 4,867,230 | A | | 9/1989 | Voss | |
| 4,898,164 | A | | 2/1990 | Baumberg | |
| 4,953,246 | A | | 9/1990 | Matthews | |
| 5,010,611 | A | | 4/1991 | Mallett | |
| 5,305,483 | A | | 4/1994 | Watkins | |
| 5,317,767 | A | | 6/1994 | Hargest et al. | |
| 5,389,037 | A | | 2/1995 | Hale | |
| 5,483,711 | A | | 1/1996 | Hargest et al. | |
| 5,675,852 | A | | 10/1997 | Watkins | |
| 5,887,304 | A | | 3/1999 | von der Heyde | |
| 6,052,853 | A | * | 4/2000 | Schmid | 5/726 |
| 6,055,690 | A | * | 5/2000 | Koenig | 5/93.1 X |
| 6,131,216 | A | * | 10/2000 | Pine | 5/423 X |
| 6,170,101 | B1 | * | 1/2001 | McCloud | 5/424 |
| 6,178,573 | B1 | * | 1/2001 | Wagner et al. | 5/424 |
| 6,263,526 | B1 | * | 7/2001 | Tu | 5/655 X |

* cited by examiner

MATTRESS AND METHOD FOR PREVENTING ACCUMULATION OF CARBON DIOXIDE IN BEDDING

This application is a Continuation of application Ser. No. 08/782,249, filed Jan. 14, 1997 now U.S. Pat. No. 6,052,853 which is a Continuation in Part of application Ser. No. 08/481,767 filed Jun. 7, 1995 now abandoned, which application(s) are incorporated herein by reference.

BACKGROUND OF THE INVENTION

The present invention relates to an apparatus and method for preventing the accumulation of carbon dioxide in bedding which is believed to be a cause or contributing factor in Sudden Infant Death Syndrome (SIDS).

Many efforts have been made to produce a mattress assembly which will prevent or reduce the occurrence of SIDS. Unfortunately, most of these approaches do not offer a good solution. The present invention solves many of the problems or shortcomings of the prior art mattress assemblies.

SUMMARY OF THE INVENTION

The present invention relates to an apparatus and method for preventing the accumulation of carbon dioxide in bedding which is believed to be a cause or contributing factor in Sudden Infant Death Syndrome (SIDS).

In one embodiment, the invention relates to a mattress assembly, comprising: substantially nonporous bottom and side walls forming a mattress foundation; a mattress inner core disposed in the mattress foundation being permeable to air; a nonporous top cover covering the mattress inner core, the nonporous top cover having apertures at predetermined locations to allow the flow of air therethrough; and a fan disposed with the mattress assembly for forcing air into the mattress inner core whereby the air is forced out the top cover so as to reduce the accumulation of carbon dioxide in bedding on the top cover of the mattress.

In another embodiment, the invention relates to a method of reducing the accumulation of carbon dioxide in bedding, comprising the steps of: forming a mattress having substantially nonporous bottom and side walls and a nonporous top cover having apertures at predetermined locations to allow the flow of air therethrough; and forcing air into an interior area of the mattress at a sufficient rate to percolate air through the top cover of the mattress.

In yet another embodiment, the invention relates to a mattress assembly having molded retaining means thereon, an inner core within the mattress assembly, a top cover and bedding attachable to the mattress foundation by the retaining means, and a fan in the mattress assembly for forcing fresh air through the mattress assembly.

These and various other advantages and features of novelty which characterize the invention are pointed out with particularity in the claims annexed hereto and forming a part hereof. However, for a better understanding of the invention, its advantages, and the objects obtained by its use, reference should be made to the accompanying drawings and descriptive matter, which form a further part hereof, and in which there is illustrated and described a preferred embodiment of the invention.

BRIEF DESCRIPTION OF THE DRAWINGS

In the drawings wherein like reference numerals indicate corresponding parts throughout the several views.

DETAILED DESCRIPTION OF THE PREFERRED EMBODIMENT

Figure 1:
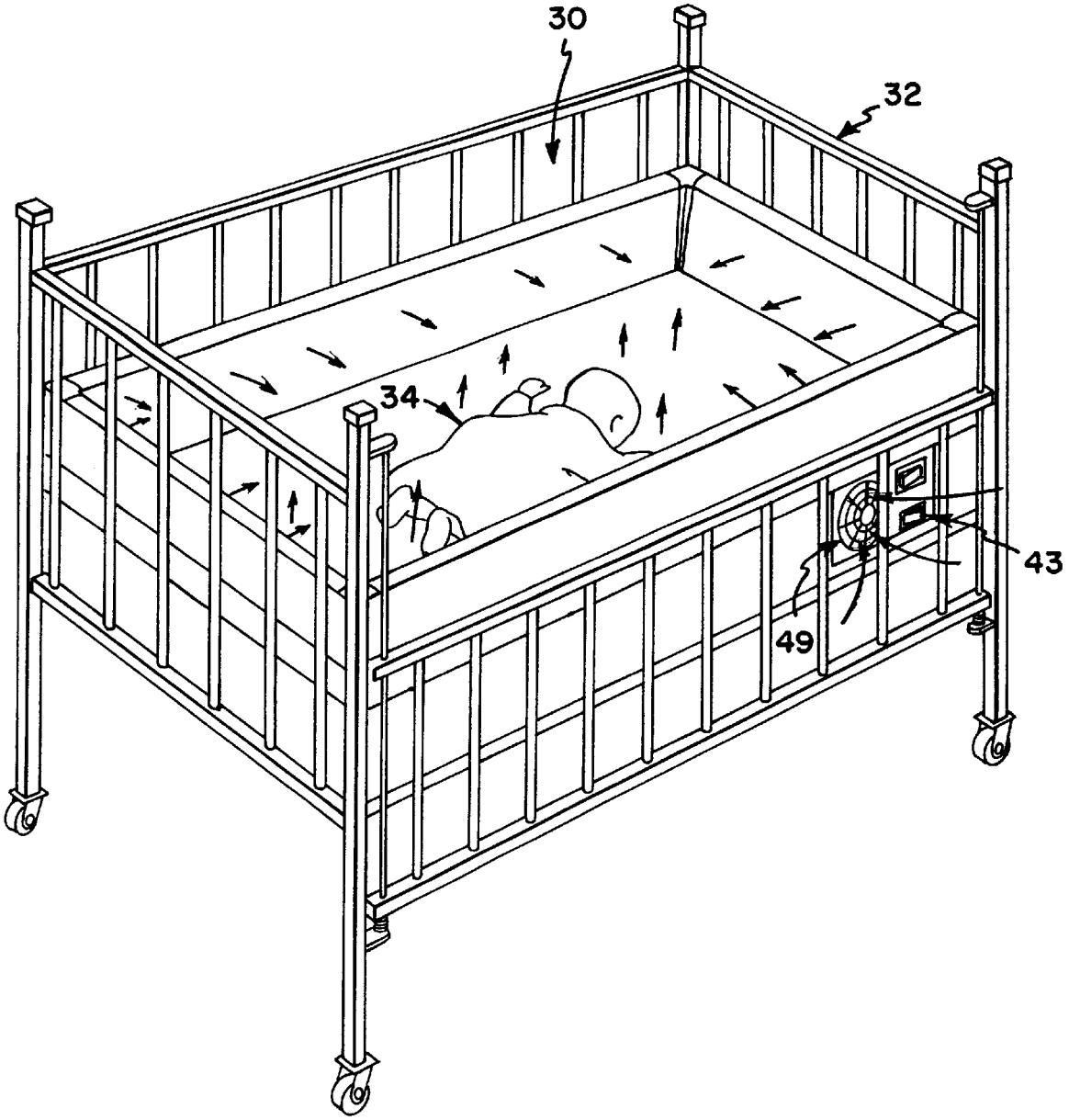
FIG. 1 is a perspective view of a preferred embodiment of a mattress assembly in accordance with the principles of the present invention disposed in a crib, an infant being illustrated as resting on the mattress assembly.

Referring now to the drawings there is shown a preferred embodiment of a mattress assembly in accordance with the principles of the present invention, the mattress assembly being generally referred to by the reference numeral 30. The mattress assembly 30 is shown in FIG. 1 as being disposed in a conventional crib 32 with an infant 34 resting on the mattress assembly 30. It will be appreciated that the mattress assembly 30 might be used with or without a conventional crib 32 as shown.

Figure 2:
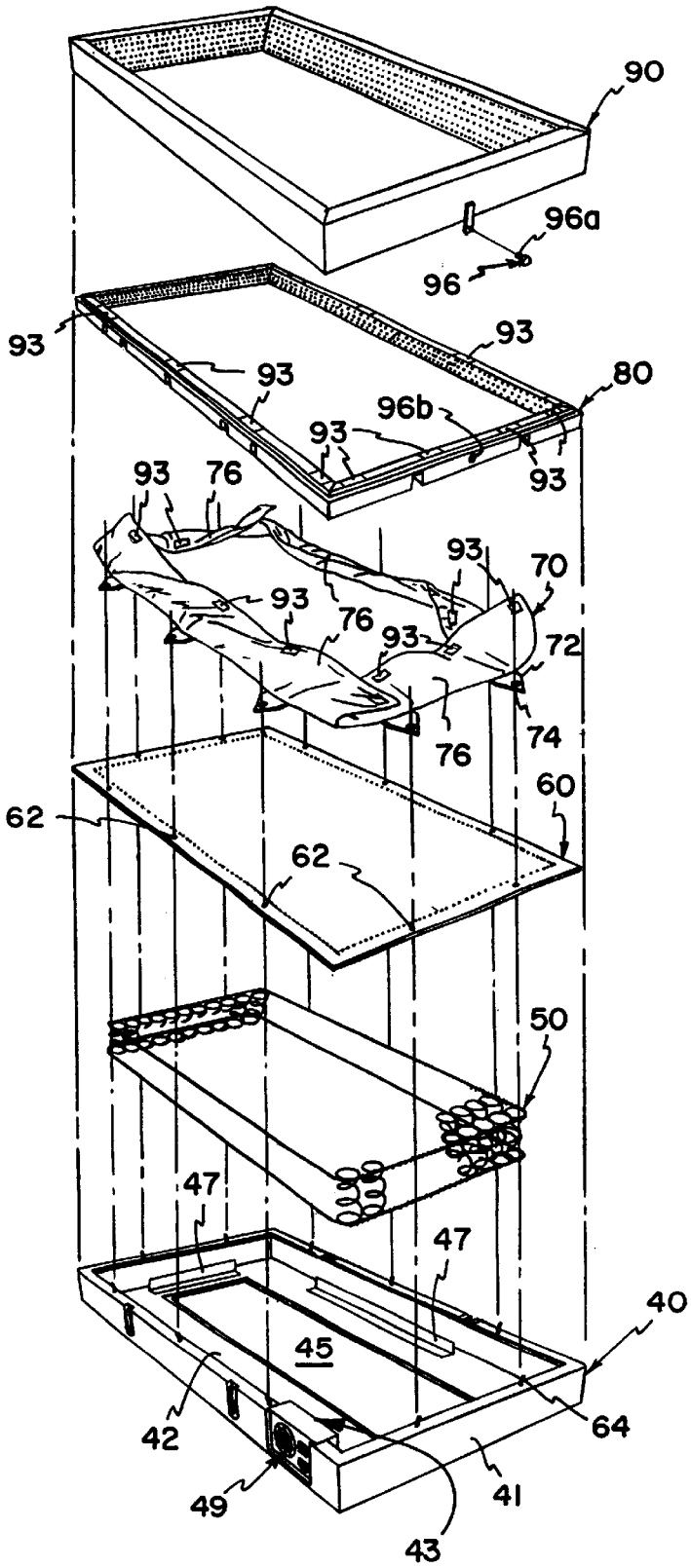
FIG. 2 is an exploded view of the mattress assembly shown in FIG. 1.

Illustrated in FIG. 2 is an exploded view of the embodiment of the mattress assembly 30 shown in FIG. 1. The mattress assembly 30 shown includes a foundation 40, an innerspring 50, a top cover 60, mattress bedding 70, a frame assembly 80, and a bumper assembly 90.

The foundation 40 includes substantially nonporous side walls 41 and a bottom wall 42 so as to form an air impermeable foundation for the mattress. The walls 41,42 might be molded as a single piece from plastic or the like. Angle brackets 47 are shown disposed on the bottom wall 42 for centering the inner spring 50. These angle brackets 47 might be separate pieces or they might be integrally molded with the foundation 40.

Figure 7:
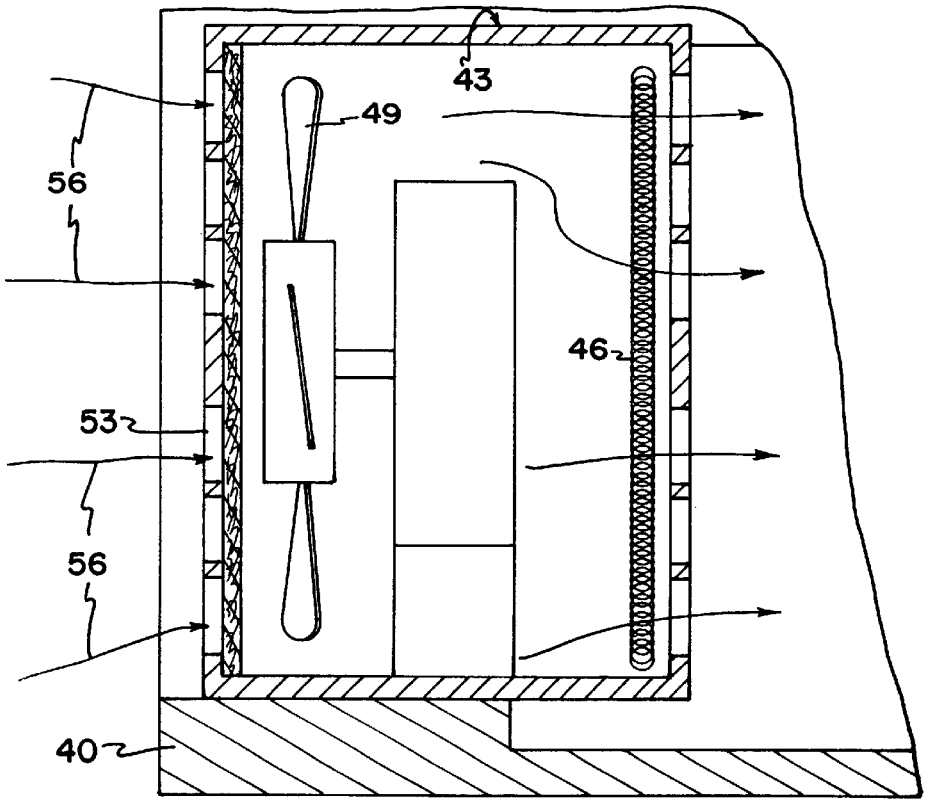
FIG. 7 is a partial cross sectional view illustrating an embodiment of the fan assembly disposed in a sidewall of the mattress assembly foundation.

As shown in FIGS. 1–2, 4 & 7, disposed in the side walls 41 is a fan assembly housing 43 housing a fan 49. As shown in FIG. 2, disposed on a top surface of the bottom wall is a heater 45. As shown in FIG. 7, in other embodiments, a heater might be present in the fan housing 43 as a heater coil 46 or the like.

The fan housing 43 will include suitable circuitry for controlling operation of the fan 49 and the heater 45/46. In the embodiment shown there are two switches 44*a,b*. Switch 44*a* is a master on off switch for the fan 49 and the heater 45/46 and switch 44*b* is for the heater 45/46 only.

Figure 3:
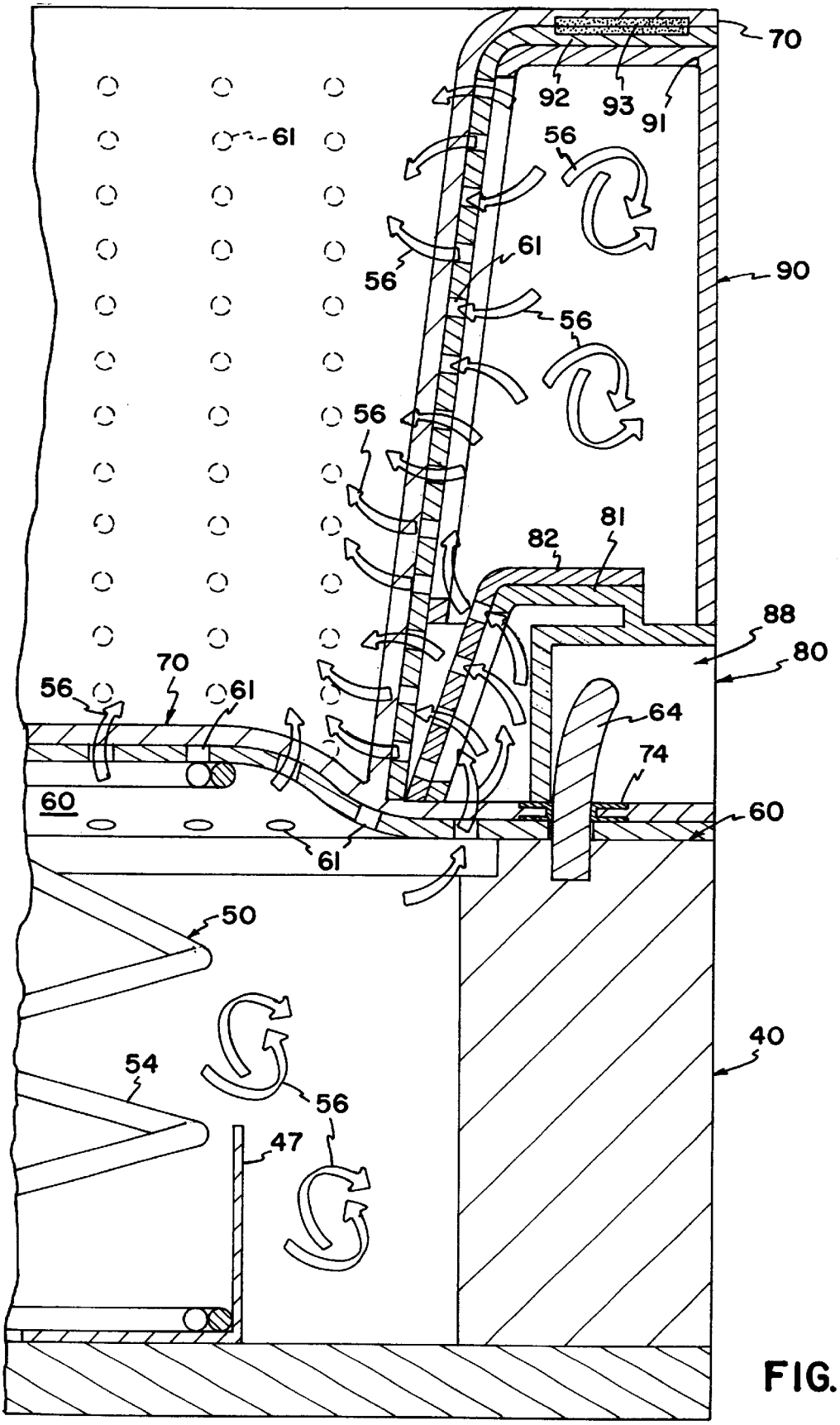
FIG. 3 is an enlarged partial sectional view illustrating air flow from the innerspring of the mattress assembly through the frame and bumper assembly and out the side walls of the frame and bumper assembly into the infant sleeping area.

As shown in FIGS. 2 and 3, the inner spring 50 is removably mounted in the mattress foundation 40. The inner spring 50 includes a plurality of coils 54 defining an open area for air flow. Air flow in the several views is generally illustrated by the arrows 56. In addition to or as opposed to the angle brackets 47, the mattress foundation 40 might further include individual guides or receptors (not shown) disposed on the bottom wall 42 for receiving each of the coils 54 to further assist in positioning of the inner spring 50. The inner spring 50 is preferably made of non-corrosive, washable material because of possible contact with saliva, sputum, urine, etc. A preferred material is galvanized spring steel.

Figure 8:
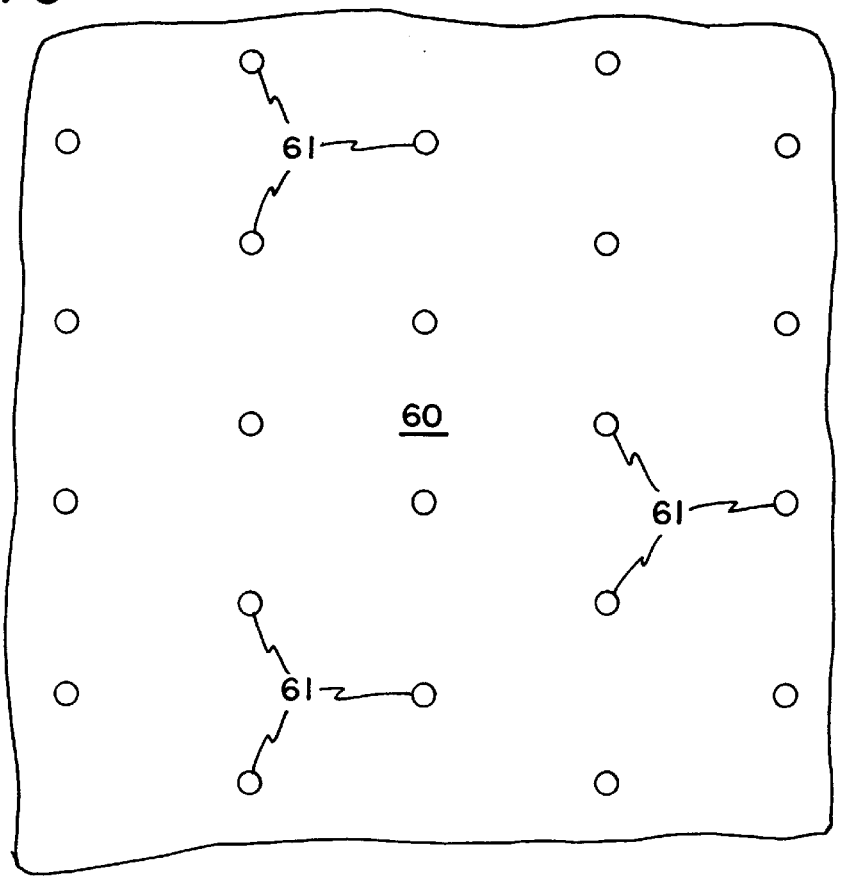
FIG. 8 is a planar view of a top cover of the mattress assembly.

As illustrated in FIG. 8, the top cover 60 is preferably made of a soft, nonporous material such as natural or synthetic rubber, vinyl, etc. so as to not harbor and provide a growth environment for bacteria or the like. Holes 61 are spaced preferably less than 2 cm apart, more preferably less than 1.5 cm apart, and most preferably on 1 cm staggered centers or less to insure that air is delivered from the innerspring 50 through the top cover 60 to at least one nostril of the infant. The diameter of the holes 61 must be large enough to prevent closing from lint, dust, etc. and yet small enough to build static pressure adequate to force air with sufficient velocity through the bedding. Over pressurizing will create air flow volumes that may cause hypothermia in infants. Under pressurizing will not have the desired effect on the bedding. Hole diameter should preferably be 3/16 inches when using fan volumes of 100 cubic feet per minute (cfm) to 170 cfm at static pressures of 0.04 inches $H_2O$ to 0.08 inches $H_2O$ and most preferably 1/8 inch diameter when used with total air flow of 25 cfm to 55 cfm at 0.01 inches $H_2O$ to 0.05 inches $H_2O$ static.

As illustrated in FIG. 2, the top cover 60 of the mattress includes apertures 62, such as eyelets or grommets, which are receivable on spaced apart projections 64 disposed on top of the side walls 41, whereby the top cover 60 is attached to the mattress foundation 40 in a taut condition. Likewise the bedding 70 is shown as including elasticized straps 72 about its periphery with apertures 74, such as eyelets or grommets, which are receivable on the projections 64, whereby the mattress bedding 70 is attached to the mattress foundation in a taut condition. In the embodiment shown, the projections are angled outward so as to facilitate retention of the top cover 60 and the bedding 70. In the preferred embodiment, the top cover 60 and the bedding 70 are taut when secured onto the projections 64. As can be seen the top cover 60 is readily removable to facilitate the cleaning of its top and bottom surfaces of saliva, sputum, urine, etc. that may collect on the top cover 60 or pass through the apertures 61 to the bottom surface of the top cover 60. The top cover 60 is simply removed or placed in position by sliding it off of and onto the projections 64.

Figure 9:
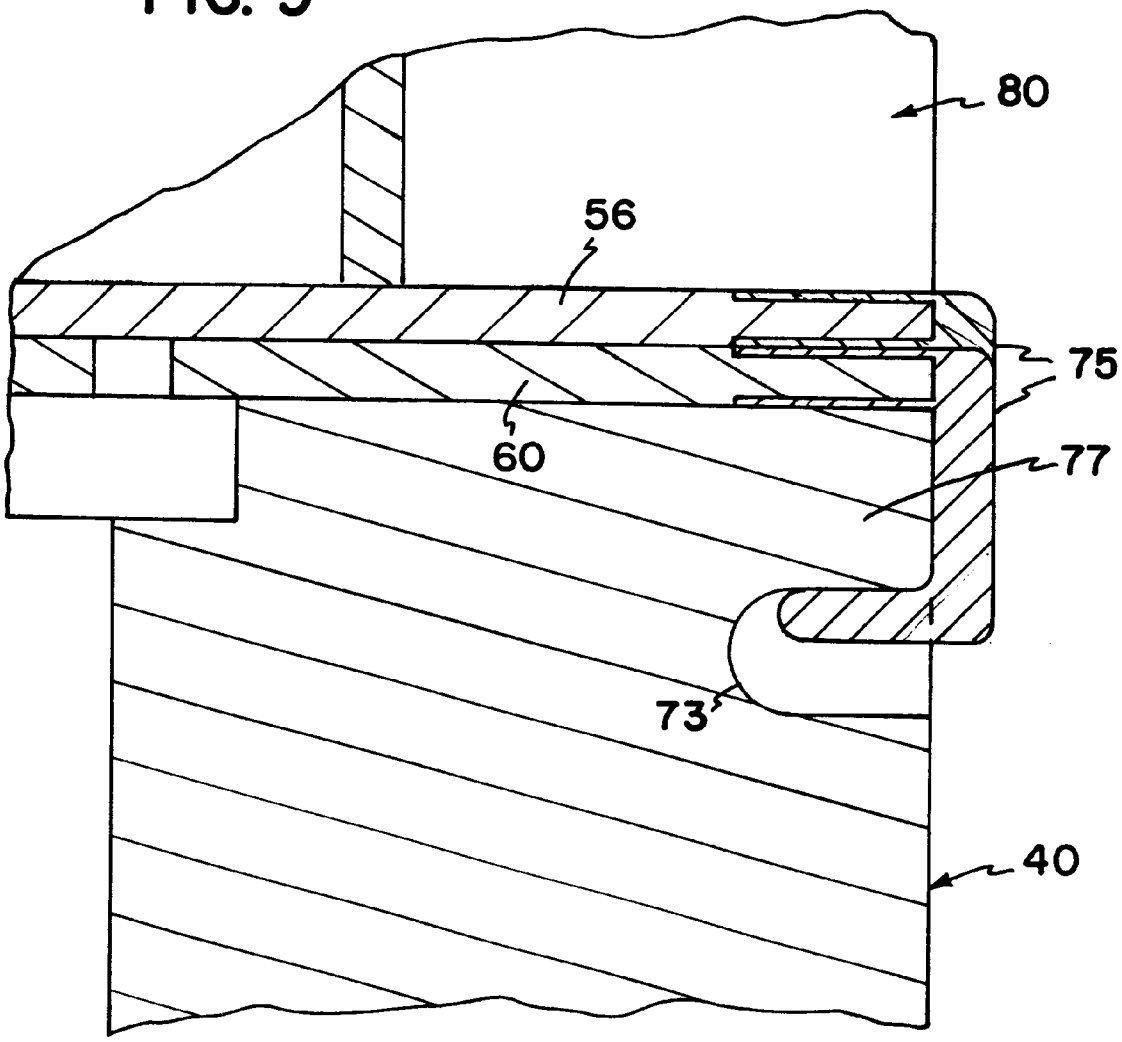
FIG. 9 is an alternate embodiment of an apparatus for attaching the top surface of the mattress assembly and the mattress bedding onto the mattress foundation.

It will be appreciated that other structures or methods might be utilized to removably mount and remove the top cover 60 without requiring tools. For example, as illustrated in FIG. 9, the top cover 60 and likewise the bedding 70, might include hooks 75 for engaging an overhanging portion 77 of the foundation 40 created by an indentation 73 disposed about the perimeter of the foundation 40 in the outside surface of the side walls 41. Preferably the hooks 75 of the bedding 70 and the top cover 60 would be spaced apart from one another so they do not overlap. This arrangement would allow the hooks 75 to be attached at any location about the perimeter of the foundation 40. Of course, in alternate embodiments tools might be required.

In the preferred embodiment, the mattress bedding 70 functions both as a mattress pad and sheet. Preferably the bedding 70 is of sufficient thickness to assure infant comfort yet be constructed of a material that when used in conjunction with the specified air flow and velocity prevents dangerous accumulations of carbon dioxide. A preferred embodiment shall be a coarsely woven, linen-like outer layer sandwiching a natural cotton batting interior devoid of resins or glues. In alternate embodiments, other porous materials might be used.

As noted above, the mattress bedding 70 is attached to the projections 64 on the foundation 40 and then the frame assembly 80 is disposed over the straps 72. The edges of the mattress bedding 70 might then be suitably attached to the frame assembly 80 and/or bumper assembly 90 by the use of straps of material 76 suitably secured to the bedding 70 which can be wrapped up and over the frame assembly 80 and/or the bumper assembly 90 and fastened thereto by VELCRO™ strips 93 or the like. In an alternate embodiment, the mattress bedding 70 might attach directly to the frame assembly 80 and/or the bumper assembly 90 so as to obviate the need to remove and replace the frame/bumper assembly when changing sheets.

The mattress foundation 40 preferably shall include rigid, impermeable, nonporous material such as plastic or wood. This will provide rigidity for keeping the top cover 60 and the mattress bedding 70 taut. As shown in FIGS. 2 and 7, it will provide a rigid compartment for installing the fan housing 43. The mattress foundation is preferably made of a material which is easily cleaned and resistant to harboring bacteria.

In the preferred embodiment, the innerspring 50 has a slightly smaller outer dimension than the inner dimension of the frame assembly 80 and is slightly higher so that when the frame assembly 80 and/or bumper assembly 90 is attached, the top cover 60 and the mattress bedding 70 are pulled down over the edges of the innerspring 50 thereby forming a slightly convex top surface.

The frame assembly 80 and the bumper assembly 90 might be a single assembly as opposed to two separate assemblies. The frame assembly 80 preferably has a height of 1.5 inches or less while the bumper assembly 90 preferably has a height of 4 to 6 inches. As shown in FIG. 3, both assemblies preferably comprise a rigid frame 81 and 91 respectively covered with a nonporous material 82 and 92, respectively, having a plurality of apertures in it. The configuration and arrangement of the apertures is preferably the same as that for the top cover 60.

As shown in FIG. 3, a bottom edge of the frame assembly 80 is preferably open to allow flow of air from the innerspring 50 through the top cover 60 and into a cavity in the frame assembly 80. The air will then pass out the apertures in the material 82 and into a cavity of the bumper assembly 90 where in turn the air will then pass out the apertures in the material 92 as generally illustrated by the arrows 56. The frame assembly 80 will provide a seal with the top surface of the mattress foundation to prevent air leakage out the sides of the mattress assembly. As shown in FIG. 3, the frame assembly 80 includes cavities 88 in alignment with and positionable over the projections 64 so as to allow the frame assembly 80 to form a seal with the mattress foundation 40.

Figure 4:
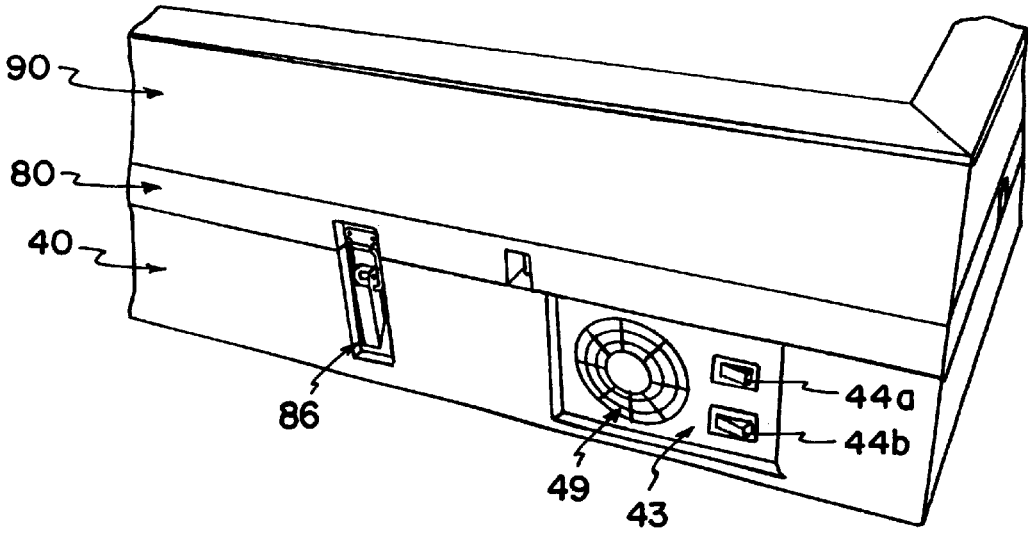
FIG. 4 is a partial perspective view illustrating an embodiment of a latch mechanism for latching the frame assembly onto the sidewalls of the mattress assembly foundation.
Figure 5:
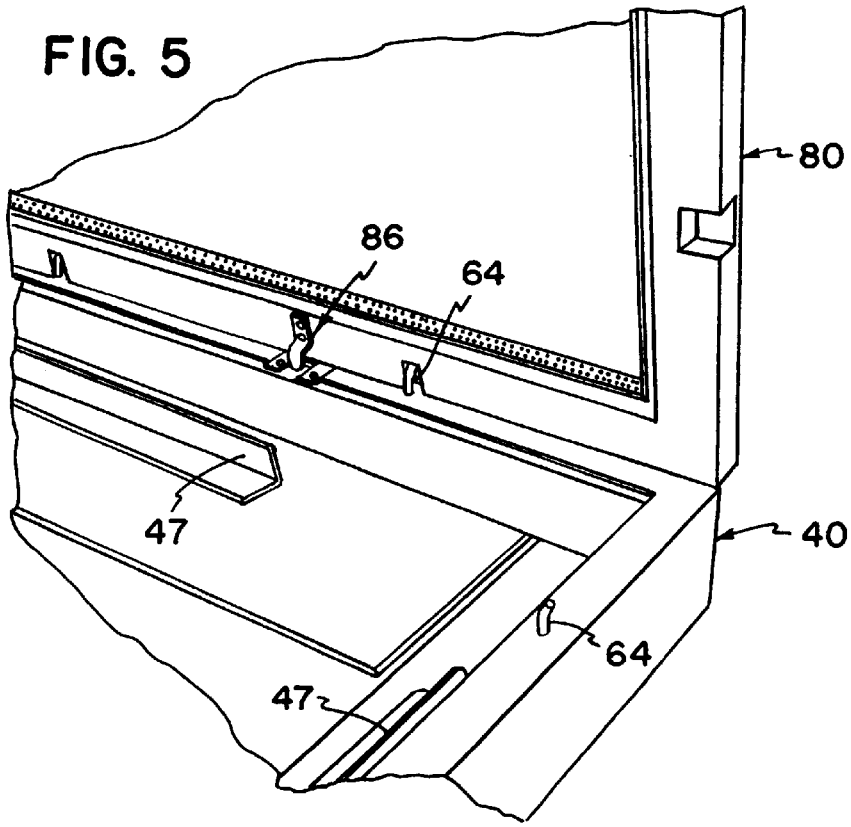
FIG. 5 is a partial perspective view illustrating the frame assembly being pivoted into an open position whereby it is no longer resting on top of the sidewalls of the mattress assembly foundation.
Figure 6:
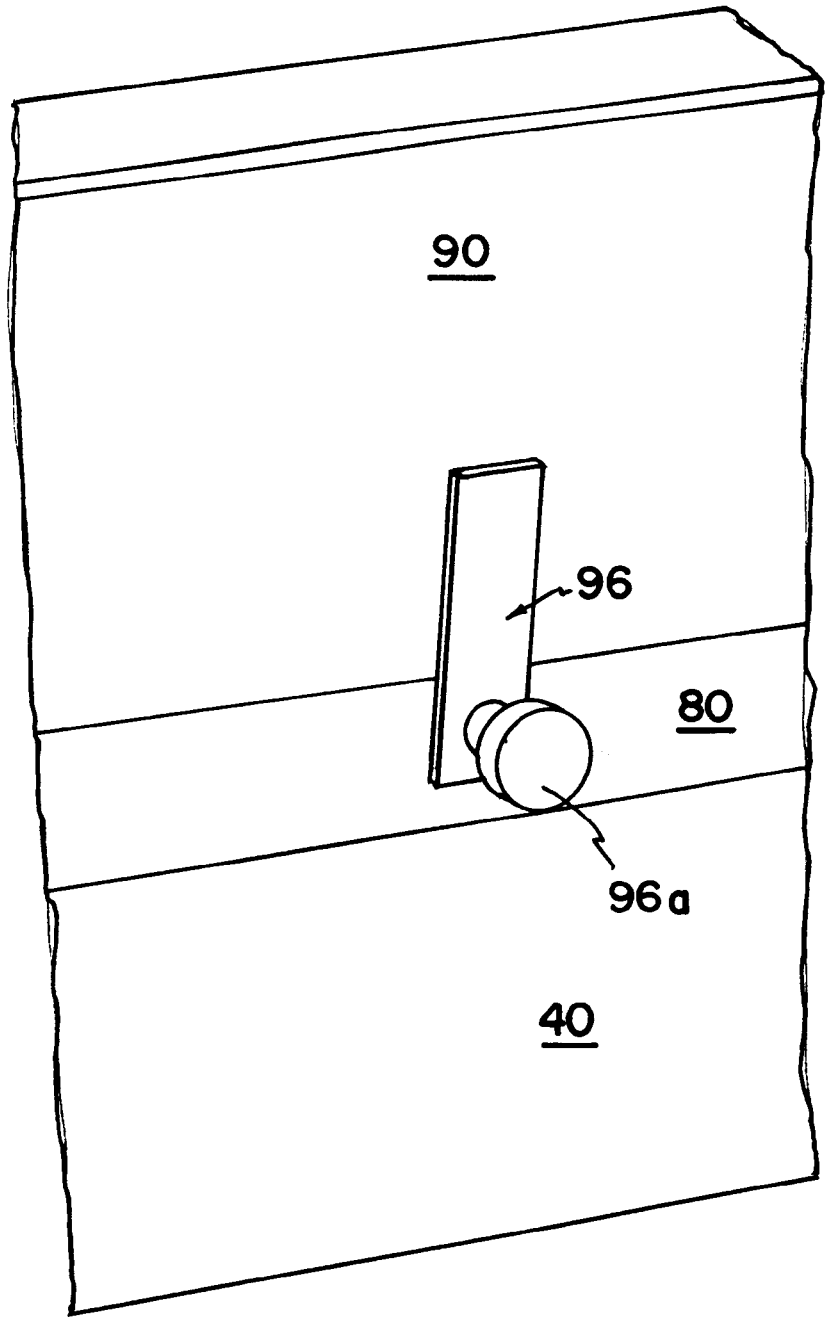
FIG. 6 is a partial side view of fastener mechanism for fastening the bumper assembly onto the frame assembly.

As shown in FIGS. 4 and 5, mechanical latches 86 preferably requiring no tools, attach the frame assembly 80 to the mattress foundation 40 and allow the frame assembly 80 to be removed and/or pivoted upward as shown in FIG. 5. Latches 96, preferably requiring no tools, attach the bumper assembly 90 to the frame assembly 80. In the preferred embodiment the latches 96 can be moved laterally to avoid interference with crib pickets.

The fan assembly is preferably a modularized assembly for easy removal by hand and without the aid of tools. In this way, the mattress assembly 30 can be sold with or without the fan assembly. The fan assembly preferably can be readily added or replaced as needed. Preferably the fan assembly is compatible with future portable mattresses such as those used in bassinets or other types of portable playpens. As shown in FIG. 2, upon removal of the frame assembly 80 the fan housing 43 can be preferably slid into place without the aid of tools. The wall of the mattress foundation 40 is open at the top so as to allow the fan housing 43 to be inserted and removed through the top of the foundation wall. The off/on switches 44*a,b* shall be inaccessible to infants or made tamperproof to prevent inadvertent stoppage of the fan. Options could include controls recessed under a latching cover or "lock-lever" type switches.

The heater 45 is preferably non-adjustable to maintain fixed air temperature at the low end of the infant's thermoneutral range of 23–27 degrees Centigrade. This is important to prevent accidental overheating which is known to contribute to SIDS while also preventing hypothermia when using unconditioned room air. A preferred embodiment will include an integral fixed temperature thermostat.

Preferably an inlet of the fan 49 will include a media filter 53 to reduce the possibility of the top surface perforations plugging with lint or dirt. Standard finger guards shall be used on the inlet and outlet of the media filter 53. This arrangement will filter the air before it reaches the compartment where the fan is located.

Preferably the fan's electrical cord will have a tamperproof plug that fastens or locks securely to a wall outlet so as to prevent inadvertent stoppage of the fan 49. The tamperproof plug might also include a transformer to convert to low voltage AC or DC current.

Figure 10A:
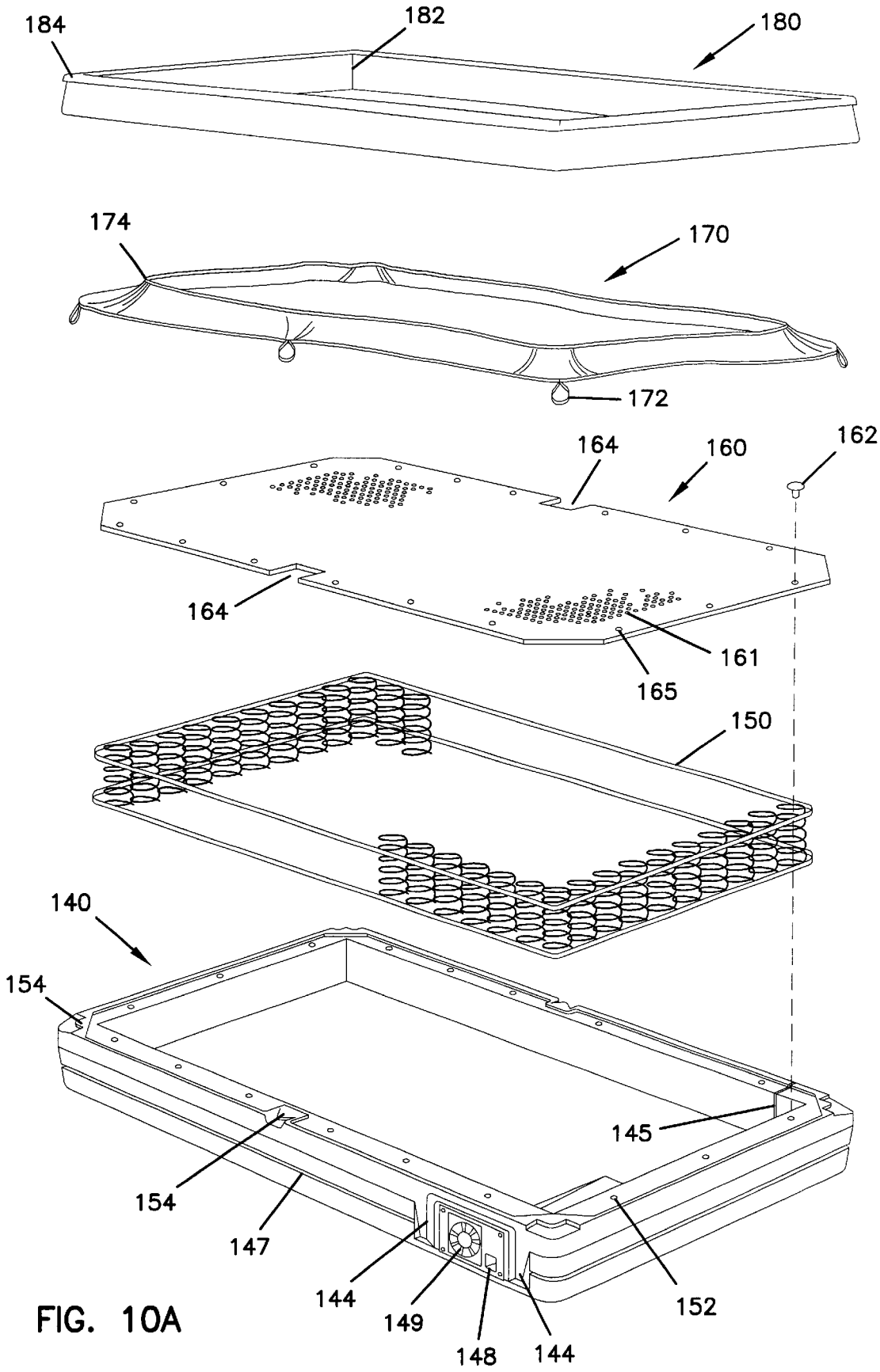
FIG. 10A is an exploded view of an alternate embodiment of the mattress assembly.

FIG. 10A illustrates an exploded view of an alternative embodiment of the mattress assembly. The mattress foundation 140 is preferably molded as a single unit from tough-skinned, closed cell foam. A low voltage fan 149 is positioned in a sidewall of the mattress foundation 140, and has a child resistant switch 148 for operation thereof. Slot 145 in the side of the mattress foundation 140 opposite from the fan 149 is provided to conduct the electrical wire from the fan 149 to the "back" of the mattress. Molded hooks 154 are provided at corners and midpoints of the side sections of the mattress foundation 140 to retain portions of the bedding 170 and thus hold the bedding 170 taut across the mattress assembly. A slot 147 runs around the periphery of the mattress foundation 140, and may hold the cuff 174 of the bedding 170. Raised shoulders 144 may be provided on either side of the fan 149 to move the cuff 174 of the bedding 170 away from the intake of the fan 149, so as to avoid reducing the flow of air through the mattress assembly. The upper surface of the sidewalls of the mattress foundation 140 are provided with a plurality of fastener receptacles 152.

A mattress inner core 150, including a plurality of springs on a wire frame, preferably formed from non-corroding material or having a non-corrosive coating, thereon rests within the mattress foundation 140. The mattress foundation 140 may be provided with rails, stops, or angle brackets for locating the inner core 150 in a desired position within the mattress foundation, as described hereinabove.

The top cover 160 is positioned on top of the inner spring 150 and is preferably attached to the mattress foundation 140 by passing fasteners 162 through peripheral holes 165 which correspond to the fastener receptacles 152 in the mattress foundation 140. The top cover 160 is provided with a plurality of apertures 161 for allowing the free flow of air therethrough. The top cover 160 is preferably provided with cuttings 164 along either side in order to allow clearance for the attachment loops 172 of the bedding 170 be reach the hooks 154 positioned at midpoints along the side of the mattress foundation 140. The cuttings may also be used as handles to facilitate easy removal of the top cover 160 from the mattress foundation 140.

The bedding 170 is placed above the top cover 160. Attachment loops 172, preferably elasticized, are provided at the corners of the bedding 170 and midpoints along the sides thereof for looping over the hooks 154 of the mattress foundation 140 to attach the bedding 170 to the mattress assembly. The bedding 170 is preferably fabricated from a porous material to allow the passage of air therethrough. The bedding 170 is provided with a cuff 174 having elastic or a drawstring therein for attaching the bedding 170 to the bumper assembly 180 or the mattress foundation 140.

A free standing bumper assembly 180, preferably fabricated from the same type of material as the mattress assembly 140 may be provided to sit on top of the mattress foundation 140. Slits 182 in the corners of the bumper assembly 180 are provided to tuck the cuff 174 of the bedding 170 and so reduce bunching of the cuff 174 at the corners.

Figure 10B:
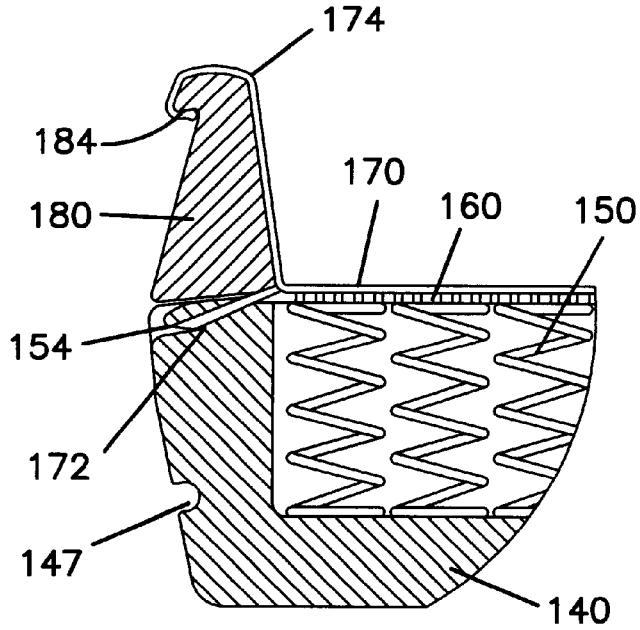
FIGS. 10B and 10C are partial cross-section views illustrating alternative methods of fastening the mattress bedding.
Figure 10C:
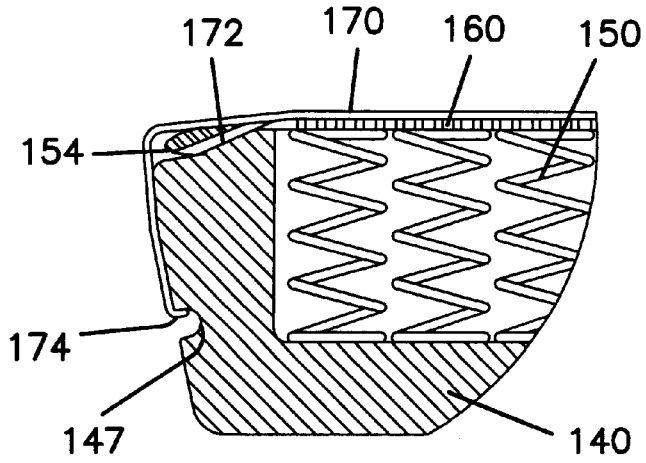

FIG. 10B illustrates a partial cross-section through the mattress assembly when the bumper pad 180 is in place. The cuff 174 of the bedding 170 is stretched over the top of the bedding 170 and held by the lip 184. Air passing up through the top cover 160 may travel up between the cuff 174 and the bumper assembly 180 and pass through the material of the cuff 174 in a direction inwards from the bumper assembly 180. This advantageously provides side ventilation without requiring that the bumper assembly 180 itself be ventilated. When the bumper assembly 180 is not in use, the cuff 174 of the bedding 170 may be inserted in the slot 147 on the periphery of the mattress foundation 140, as is illustrated in FIG. 10C. The embodiment illustrated in FIGS. 10A–10C may be readily taken disassembled to permit access to all components for cleaning or other maintenance.

Having read the foregoing description, it is to be understood, that even though numerous characteristics and advantages of various embodiments in accordance with the principles of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad general meaning of the terms in which the appended claims are expressed.

I claim:

1. A mattress comprising:

a mattress foundation comprising a bottom wall and side walls, said bottom wall and said side walls are generally rigid and nonporous, and said bottom wall and said side walls defining a cavity that is open at the top thereof;

a top cover detachably connected to said side walls and covering the top of the cavity to form, with said bottom wall and said side walls, a chamber; said top cover being nonporous except for apertures therethrough to allow airflow between the chamber and the exterior of the mattress foundation;

a fan mounted to said mattress foundation for forcing air into the chamber and out the top cover through said apertures, wherein the size and spacing of the apertures and an air flow volume provided by the fan are chosen so as to effectively reduce accumulation of carbon dioxide in bedding on the top cover;

a bumper assembly disposed on said side walls and extending upwardly therefrom above a level of said top cover, and bedding disposed over said top cover and disposed over said bumper assembly for directing air from the chamber to the bumper assembly, wherein the portion of said bedding disposed over said bumper assembly is porous whereby side ventilation is provided.

2. A mattress in accordance with claim 1, wherein said apertures are spaced apart by less than 2 cm, said apertures have a diameter between 3/16 inch and 1/8 inch, and said fan provides an air flow volume of between 25 and 170 cubic feet per minute.

3. A mattress in accordance with claims 1, further comprising an inner core disposed within the chamber, said inner core being removably mounted within the chamber.

4. A mattress in accordance with claim 1, further including bedding disposed over said top cover, and means associated with said side walls for maintaining the bedding in a taut condition.

5. A mattress in accordance with claim 4, wherein said means comprises a bumper assembly disposed on said side walls.

6. A mattress in accordance with claim 4, wherein said means comprises attachment fixture provided on said side walls.

7. A mattress, comprising:

a mattress foundation comprising a bottom wall and side walls, said bottom wall and said side walls are generally rigid and nonporous, and said bottom wall and said side walls defining a cavity that is open at the top thereof;

a top cover detachably connected to said side walls and covering the top of the cavity to form, with said bottom wall and said side walls, a chamber; said top cover being nonporous except for apertures therethrough to allow airflow between the chamber and the exterior of the mattress foundation;

a fan mounted to said mattress foundation for forcing air into the chamber and out the top cover through said apertures, wherein the size and spacing of the apertures and an air flow volume provided by the fan are chosen so as to effectively reduce accumulation of carbon dioxide in bedding on the top cover;

a side assembly disposed on said side walls and extending upwardly therefrom above a level of said top cover, and means for directing air from the chamber to said side assembly whereby side ventilation is provided; and wherein said side assembly comprises a frame assembly and a bumper assembly, and said means for directing air comprises flow passages in said frame assembly and said bumper assembly.

8. A mattress, comprising:

a mattress foundation comprising a bottom wall and side walls, said bottom wall and said side walls are generally rigid and nonporous, and said bottom wall and said side walls defining a cavity that is open at the top thereof;

a top cover detachably connected to said side walls and covering the top of the cavity to form, with said bottom wall and said side walls, a chamber; said top cover being nonporous except for apertures therethrough to allow airflow between the chamber and the exterior of the mattress foundation;

a fan mounted to said mattress foundation for forcing air into the chamber and out the top cover through said apertures, wherein the size and spacing of the apertures and an air flow volume provided by the fan are chosen so as to effectively reduce accumulation of carbon dioxide in bedding on the top cover; and an inner core disposed within the chamber, said inner core being removably mounted within the chamber and extending above the level of said side walls.

9. A crib assembly comprising:

a mattress including:

a mattress foundation having a bottom wall and side walls, said bottom wall and said side walls are generally rigid and nonporous, and said bottom wall and said side walls defining a cavity that is open at the top thereof;

a top cover detachably connected to said side walls and covering the top of the cavity to form, with said bottom wall and said side walls, a chamber; said top cover is nonporous except for apertures therethrough to allow airflow between the chamber and the exterior of the mattress foundation;

a fan mounted to said mattress foundation for forcing air into the chamber and out the top cover through said apertures, wherein the size and spacing of the apertures and an air flow volume provided by the fan are chosen so as to effectively reduce accumulation of carbon dioxide in bedding on the top cover; and a bumper assembly disposed on said side walls and extending upwardly therefrom above a level of said top cover, and bedding disposed over said top cover and disposed over said bumper assembly for directing air from the chamber to the bumper assembly, wherein the portion of said bedding disposed over said bumper assembly is porous whereby side ventilation is provided; and a crib supporting the mattress.

10. A crib assembly in accordance with claim 9, wherein said apertures are spaced apart by less than 2 cm, said apertures have a diameter between 3/16 inch and 1/8 inch, and said fan provides an air flow volume of between 25 and 170 cubic feet per minute.

11. A crib assembly, comprising:

a mattress including:

a mattress foundation having a bottom wall and side walls, said bottom wall and said side walls are generally rigid and nonporous, and said bottom wall and said side walls defining a cavity that is open at the top thereof;

a top cover detachably connected to said side walls and covering the top of the cavity to form, with said bottom wall and said side walls, a chamber; said top cover is nonporous except for apertures therethrough to allow airflow between the chamber and the exterior of the mattress foundation;

a fan mounted to said mattress foundation for forcing air into the chamber and out the top cover through said apertures, wherein the size and spacing of the apertures and an air flow volume provided by the fan are chosen so as to effectively reduce accumulation of carbon dioxide in bedding on the top cover;

a side assembly disposed on said side walls and extending upwardly therefrom above a level of said top cover, and means for directing air from the chamber to said side assembly whereby side ventilation is provided, wherein said side assembly comprises a frame assembly and a bumper assembly, and said means for directing air comprises flow passages in said frame assembly and said bumper assembly; and a crib supporting the mattress.

* * * * *